US008053706B2

(12) United States Patent
Katterman et al.

(10) Patent No.: US 8,053,706 B2
(45) Date of Patent: Nov. 8, 2011

(54) SENSOR ISOLATION PLANE FOR PLANER ELEMENTS

(75) Inventors: James A. Katterman, Waterford, MI (US); David P. Wallace, II, Shelby, OH (US); David P. Wallace, legal representative, Shelby, OH (US); Linda L. Wallace, legal representative, Shelby, OH (US)

(73) Assignee: Delphi Technologies, Inc., Troy, MI (US)

( * ) Notice: Subject to any disclaimer, the term of this patent is extended or adjusted under 35 U.S.C. 154(b) by 770 days.

(21) Appl. No.: 11/989,587

(22) PCT Filed: Jul. 28, 2006

(86) PCT No.: PCT/US2006/029750

§ 371 (c)(1),
(2), (4) Date: Apr. 15, 2008

(87) PCT Pub. No.: WO2007/014388

PCT Pub. Date: Feb. 1, 2007

(65) Prior Publication Data

US 2009/0255916 A1 Oct. 15, 2009

(51) Int. Cl.
*F23Q 7/22* (2006.01)

(52) U.S. Cl. ..... 219/267

(58) Field of Classification Search ..... 219/267, 219/260–266, 268–270
See application file for complete search history.

(56) References Cited

U.S. PATENT DOCUMENTS 4,945,721 A 8/1990 Cornwell et al.
4,980,557 A 12/1990 Myers et al.
5,874,314 A 2/1999 Loepfe et al.

FOREIGN PATENT DOCUMENTS

SU 1012058 * 4/1983

OTHER PUBLICATIONS

EP Search Report dated Nov. 30, 2009.
International Search Report.

* cited by examiner

*Primary Examiner* — Daniel L Robinson
(74) *Attorney, Agent, or Firm* — Thomas N. Twomey

(57) ABSTRACT

Elimination of sodium contamination at the negative terminal of an electrical stri resistance heater (1, FIGS. 2 and 4) for a gas sensor (3) can be accomplished by providing a grounding plane (-18') electrically connected to system ground and located between the heater (1) and the sensor (3).

2 Claims, 4 Drawing Sheets

SENSOR ISOLATION PLANE FOR PLANER ELEMENTS

FIELD OF THE INVENTION

The present invention relates to a structure suitable for extending the useful lifetime of an electrical resistance heater employed for heating an ion-containing substrate.

BACKGROUND AND SUMMARY OF THE INVENTION

It was recognized at least as early as 1969 that a planar resistor was exposed to shortened lifetime if sodium ions were permitted to collect in the vicinity of the negative terminal of the resistor. U.S. Pat. No. 3,598,956 identified this problem and proposed a solution including providing a conductive barrier that could optionally be electrically biased relative to the resistors.

Other known prior art utilized a collector member that was connected to the negative terminal of the resistive heater. This was suggested at least as early as 1985, as disclosed in U.S. Pat. No. 4,733,056, and has more recently been commercialized, for instance in many current production motor vehicles employing a planar oxygen sensor provided by Delphi Automotive Systems and identified as the OSP+. In arrangements where the collector member is connected to the heater terminal, and when the heater is turned OFF, there is no electrical field between the collector element and the heater. When OFF no current flows through the heater and there is no potential drop along the length of the heater. Also, in typical implementations where the heater control involves electrically disconnecting the heater from ground to turn the heater OFF, the entire heater goes positive when turned OFF because of the connection of the positive lead to the power supply, but so does the collector member. As a result, the ion collection function is only operative when the heater is operating. This arrangement misses the opportunity to capture ions when the heater is not ON. The substrate typically starts out cold, thus creating a condition that is not conducive to ionic migration through the substrate. Because the ions in the substrate are more mobile at higher temperatures, they are most mobile when the heater is ON and then adjacent to the heater element. Also, because there is a voltage gradient along the length of a resistance heater when in operation, the ions tend to follow the electrical field along the direction where they have the greatest mobility. The higher temperatures along the heater, combined with the electrical field gradient along the length of the heater causes ions to migrate toward the negative terminal of the heater. This ion collection at the negative heater terminal shortens heater lifetime by physically forcing the heater terminal away from the heater leads, causing the connection to the conductive heater leads to be broken. This physical force is due to the physical presence of the ions gathering between the negative heater terminal and its lead.

It has now been discovered that in order to prevent ionic buildup near a terminal of a planar electrical resistance heater (a buildup that can damage the heater and break the electrical connection between the heater and its conductive lead), an ion collector can be employed near the heater to continuously attract the ions. An electrical field is established between the heater and the ion collector attracting the mobile ions toward the ion collector and repelling them away from the heater. To improve the operation of the ionic collection, the collector member is maintained at its attracting potential even when the heater is OFF or is operating at less than full power. Also, the heater is connected so as to establish a high electrical potential difference relative to the ion collector when the heater is OFF repelling the ions from the heater element and toward the ion collector. A heater control mechanism is employed to turn the heater on/off as desired and to regulate the voltage supplied to the heater if it is desired to operate the heater at less than full power. Preferably, the heater control is located between the negative heater terminal and ground.

DETAILED DESCRIPTION OF THE INVENTION

Figure 1A:
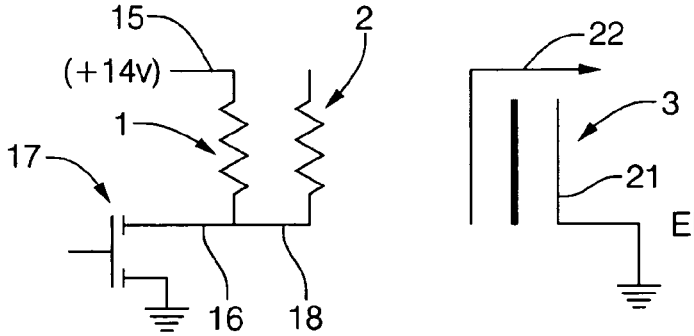
PRIOR ART FIG. 1 A
FIGS. 1*a* and 1*b* illustrate a prior art heater and sensor embodiment.
Figure 1B:
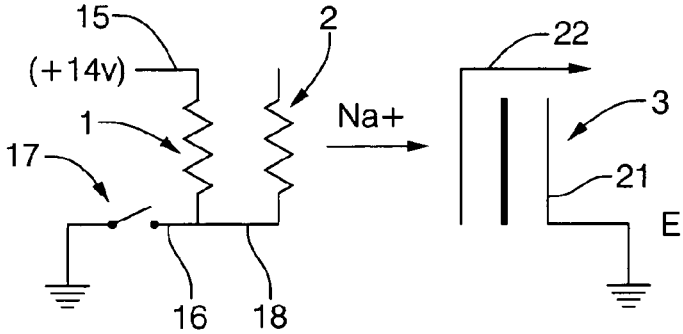
PRIOR ART FIG. 1 B

FIGS. 1*a* and 1*b* illustrate a prior art arrangement that has an electrical connection between the heater element 1 and the ion collector 2. As shown in FIG. 1*a*, when the heater is ON, the positive lead 15 of heater element 1 is connected to the positive supply, typically 14 volts, and the negative lead 16 is connected to the negative supply by heater control circuit 17. When the heater is ON, as shown in FIG. 1*a*, there is a strong electrical field in the vicinity of the positive connection while there is a weaker electrical field nearer to the negative terminal. The voltage drop along the length of the resistive heater causes the difference in field strength. Near the negative terminal, the field may be negligible because both the ion collector and the conductive lead are at approximately the same potential. Typically, because of the diode drop associated with the switching control circuit 17, the negative heater terminal stays slightly above system ground, perhaps by 0.7 volts. The ion collector is maintained at this same potential as the negative heater terminal. Since there is no current through the ion collector, there is no voltage change along its length.

When the heater is OFF, as shown in FIG. 1*b*, switch 17 isolates the heater from ground allowing the heater and the ion collector to equalize at a single potential. Because there is no current flowing through the heater, there is no potential loss along the length of the heater. Since the ion collector is connected to a heater lead, the ion collector rises to the potential of the positive dc source, along with the heater. There is no potential difference between the heater and the ion collector, thus there is no field to cause ion migration toward the ion collector. When the heater is OFF the ion collection function is not active. However, because the ion collector is at a high potential there is a tendency for ions to migrate away from the ion collector. This would be the situation whenever the body of the substrate is at a potential lower than the positive supply potential provided by the dc power supply. Since there is nothing causing the substrate to be at a higher potential, and since there are factors tending to cause the substrate to fall to a lower potential, such as the grounded lead 21 of the sensor 3, there will be some migration of ions away from the ion collector, potentially allowing them to end up in locations where they will be detrimental, at least relative to their expected consequences if they were still attracted to the ion collector.

Also shown in FIGS. 1*a* and 1*b* is the sensor element 3 that is heated by heater 1. The sensor 3 includes two electrical leads, lead 21 connected to ground and lead 22 providing the sensor output signal. The construction and operation of a feasible sensor is described in U.S. Pat. No. 6,562,215, although the particular structure of the sensor is not material to the structure and operation of the present invention, other than establishing the need for a heater.

Figure 2A:
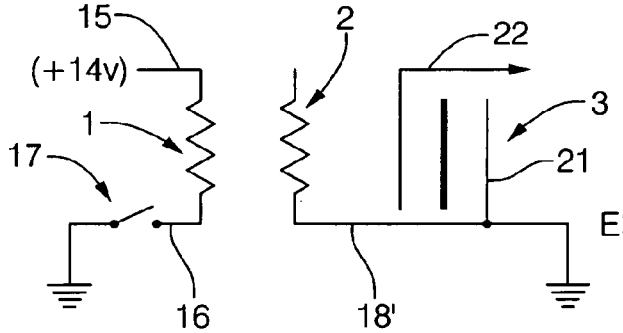
FIGS. 2*a* and 2*b* illustrate a preferred embodiment of the invention.
Figure 2B:
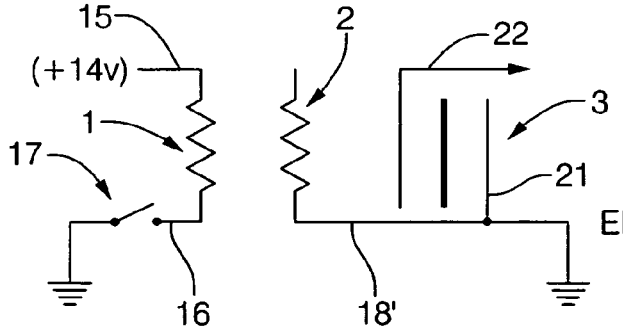

FIGS. 2*a* and 2*b* illustrate an embodiment of the present invention. The ion collector 2 is electrically connected to the negative lead 21 of oxygen sensor 3, via lead 18'. This has the consequence that the ion collector is directly connected to ground rather than sometimes being separated from ground by switch 17. Switch 17 continues to regulate the connection of lead 16 to ground. This modification results in several functional differences in the effectiveness of the ion collector. First, the potential of the ion collector may be slightly lower (for instance by whatever electrical drop occurs across switch 17) than in the embodiment of FIG. 1*a* when the switch is ON. Second, when the switch is OFF there is a strong electric field tending to cause ions to migrate away from the heater and toward the ion collector. And, third, the ion collector never goes to the high potential of the positive voltage source and thus does not tend to repel any of the ions that have previously been attracted, either toward the heater, or back into the substrate.

In one desirable implementation of the invention, the ion collector has a shape generally tracking the heater traces allowing for the efficient use of the ion collector material. This results in location of the ion collector in the specific locations where the electric field strength will be optimized while the heater is ON as well as when it is OFF. Further, this reduces the overall quantity of ion collector material relative to implementations in which the ion collector is not so configured.

If the ion collector is formed according to a conventional thick film process, manufacturing processes allow for efficient overall construction. The firing of the heater traces can be accomplished in the same process steps as used for firing of the ion collector. This obviates the need for redundant process steps while producing a high quality overall structure.

Figure 3:
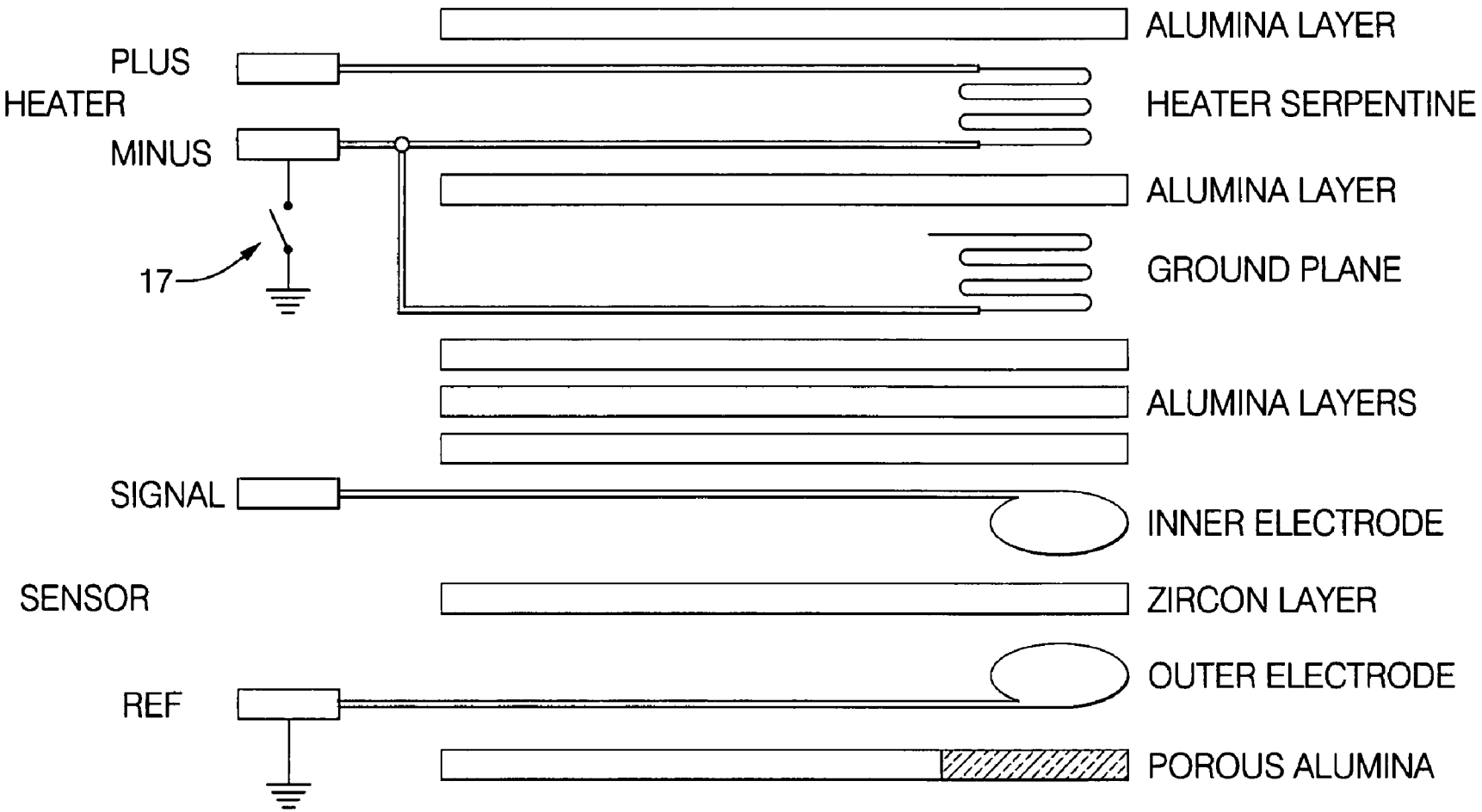
PRIOR ART FIG. 3
FIG. 3 illustrates a typical structural layout used prior to the present invention.

FIG. 3 shows the structural elements that have been employed to fabricate a prior art structure having a sensor portion and a heater portion, the heater portion being connected to an intermediate ground plane. As can be seen, multiple layers of alumina have been built up with the heater and ground plane provided through the use of a thick film process. Power to the heater is regulated by switch 17 capable of isolating the heater and ground plane from system ground.

Figure 4:
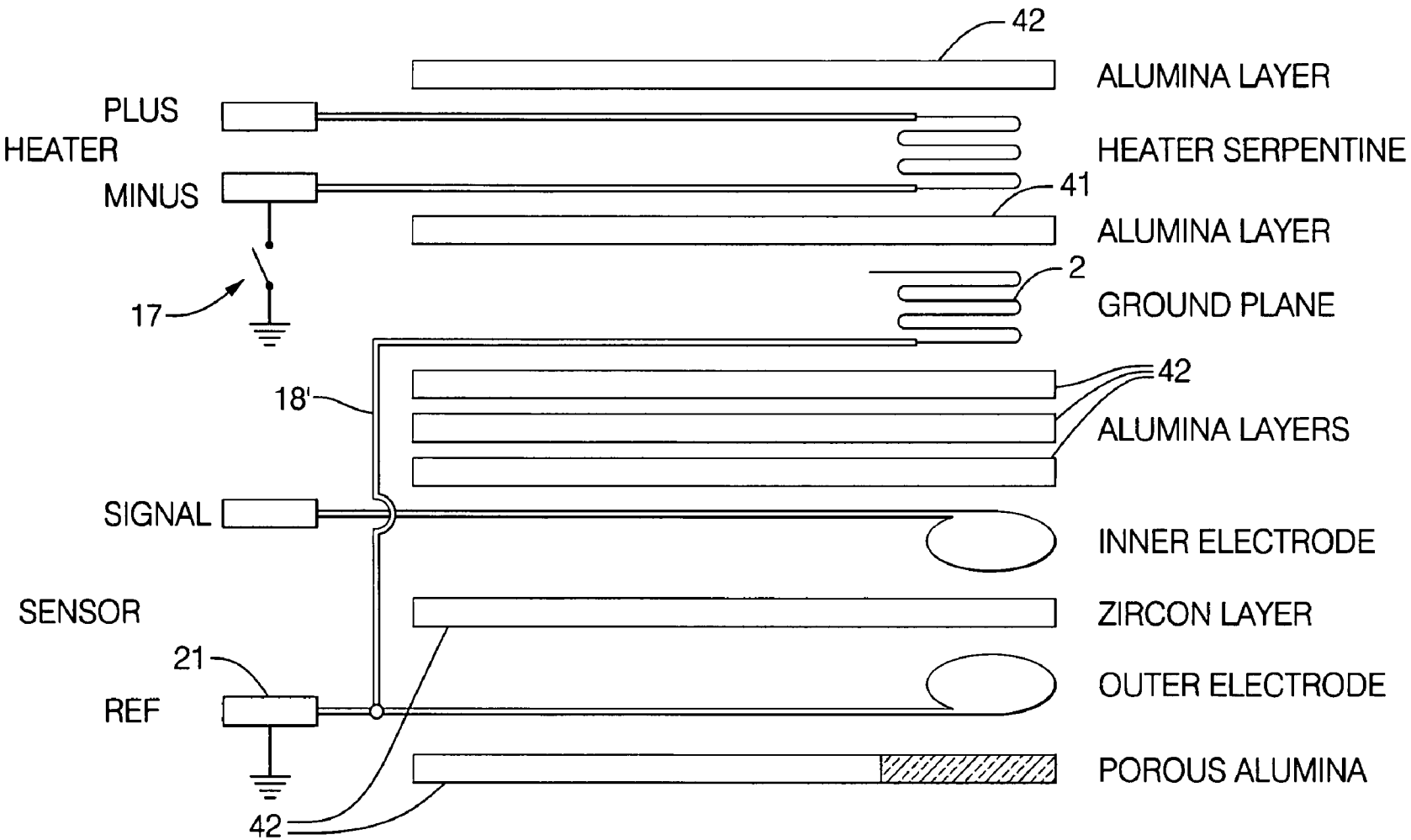
FIG. 4 illustrates a typical structural layout suitable for implementing the invention.

FIG. 4 illustrates an embodiment of the invention where conductor 18' connects the ground plane to system ground without running through switch 17. This configuration allows the ground plane to remain at system ground even when the heater is isolated from ground. The benefits of this arrangement were described previously in connection with the description of FIG. 2.

The negative lead 21 is adapted for connection to ground, preferably without any intermediate circuitry in order to cause this lead to be at the lowest (most negative) potential available and thus to optimize the collection of positive ions at the ion collector. While benefits are still obtainable so long as the ion collector is at a lower potential then the body of the substrate, particularly the portion of the substrate formed by layer 41, best performance is obtained when the potential at lead 21 is kept as low as possible.

The ion collector 2 is separated from the heater by a thin layer of insulating material, typically alumina, shown as layer 41. However, in the manufacturing process it is often desirable to have multiple individual layers 41, 42 of insulating material fused together in a sintering, or 'firing' step. This creates an integral substrate suitable for handling without significant risk of damage. Individual layers of the insulating material are generally sufficiently thin that they can not withstand handling.

An advantage of firing the composite structure is that the sensor, ion collector and heater are enclosed within the ultimate resulting element providing good physical and electrical protection to the various elements of the composite structure. After firing, there is little to no residual structure resembling individual layers, but rather the substrate is generally homogeneous. Typically there is an effort to select materials for the substrate that are free of impurities. However, perfection is difficult to achieve and it is generally found that sodium ions, along with other positive ions, are present in the substrate.

Figure 5:
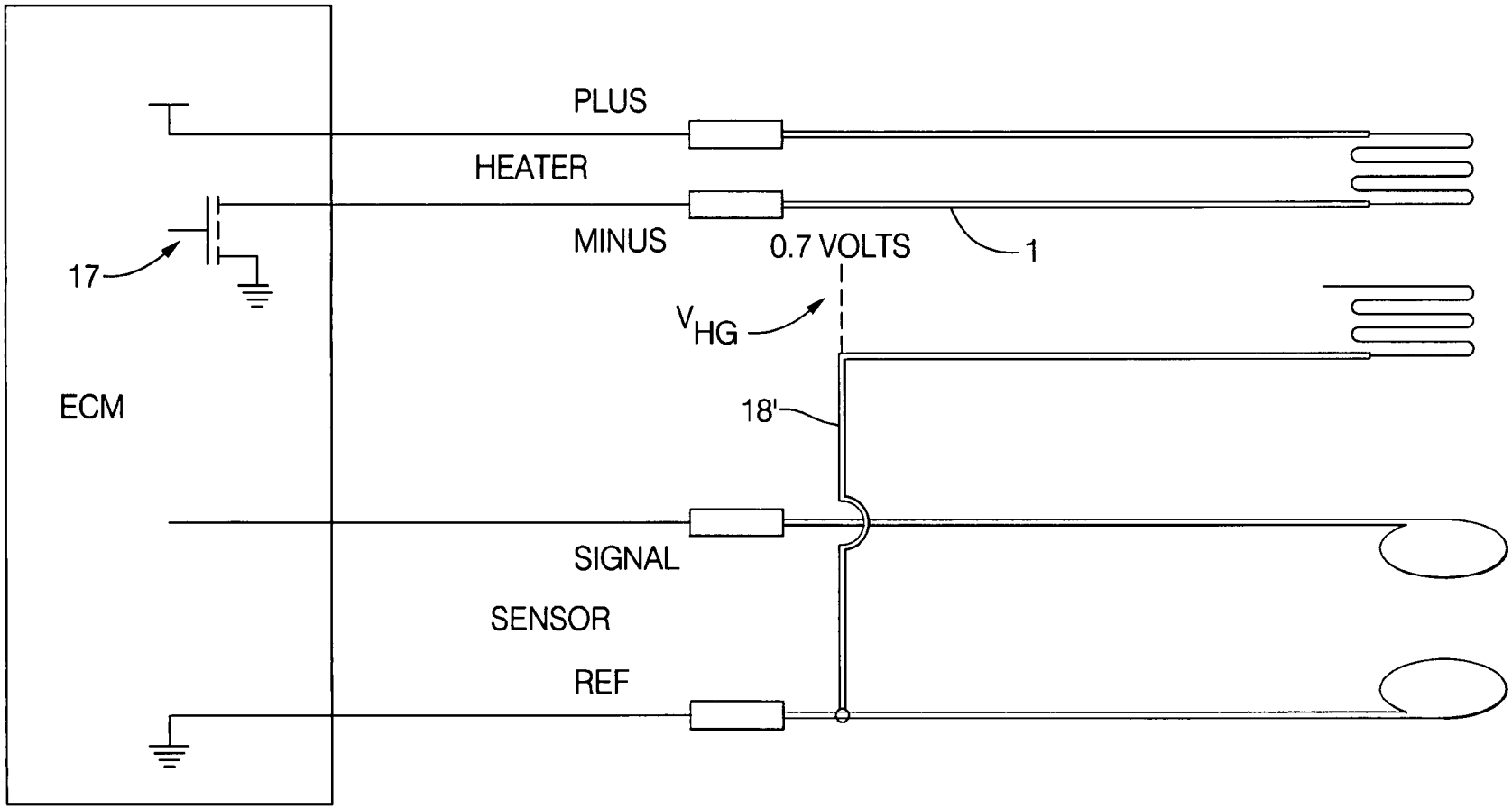
FIG. 5 illustrates the placement of the elements of an embodiment of the invention.

FIG. 5 illustrates the voltage differential $V_{HG}$ existing between the negative end of the heater lead $\mathbf{1}_N$ and the ground plane lead 18' when switch 17 is ON. The voltage differential $V_{HG}$ is the result of the diode drop (approximately 0.5 to 0.7 volts) across switch 17 plus any voltage loss resulting from the resistance present in the negative conductive lead from the heater to the switch. Of course, $V_{HG}$ is much higher when switch 17 is OFF, generally equal to the battery voltage of roughly 12 to 14 volts. The control of the heater is regulated by control circuitry well known for the function of controlling current, and is not specifically shown here. As used herein, controlling the current supplied to the heater may include simply connecting or disconnecting the negative lead to ground through a simple transistor switch, or through any other switching mechanism, the operative function being simply to either connect the lead for completing the circuit through the heater or to break the connection. The circuit can be completed at full power, or at reduced power, such as would be accomplished by varying the voltage level supplied to the negative lead or by employing a modulated supply level, such as by pulse width modulation, pulse amplitude modulation or pulse density modulation.

While the present invention has been described with reference to the illustrated embodiments, it is to be understood that these embodiments are described by way of example only and are not intended to limit the scope of the following claims.

The invention claimed is:

1. An integrated heater element with ionic contamination protection comprising:

an electrical resistance heater located on the front side of a first ceramic layer, said heater having a first lead connected to a positive voltage source and a second lead controllably connected to ground; and a grounded ion collector located on the back side of said first ceramic layer.

2. A combination sensor element and controlled electrical heater for said sensor, said combination comprising:

a sensor element having first and second electrical leads;

a grounded ion collector; and an electrical heater having a positive lead for connection to a dc power source and a negative lead for connection to a heater controller;

said grounded ion collector located between said heater and said sensor and separated from the heater by a solid insulating layer.

* * * * *